United States Patent [19]

Claxton et al.

[11] 4,417,694

[45] Nov. 29, 1983

[54] INJECTOR VALVE WITH CONTOURED VALVE SEAT AND NEEDLE VALVE INTERFACE

[75] Inventors: William B. Claxton, West Bloomfield, Mich.; Joseph C. Cromas, Newport News, Va.

[73] Assignee: The Bendix Corporation, Southfield, Mich.

[21] Appl. No.: 199,124

[22] Filed: Oct. 22, 1980

[51] Int. Cl.[3] ..... F02M 61/00

[52] U.S. Cl. ..... 239/533.12

[58] Field of Search ..... 239/533.3, 533.4, 533.5, 239/533.12, 533.8, 533.9, 533.6, 533.7, 533.2, 553, 589

[56] References Cited

U.S. PATENT DOCUMENTS

| | | | |
|---|---|---|---|
| 1,898,763 | 2/1933 | Cowardin et al. . | |
| 2,338,744 | 1/1944 | Szekely . | |
| 2,927,737 | 3/1960 | Zeuch et al. . | |
| 2,964,286 | 12/1960 | Hoskins . | |
| 3,069,099 | 12/1962 | Graham . | |
| 3,241,768 | 3/1966 | Croft . | |
| 3,838,821 | 10/1974 | Berlyn | 239/533.7 |
| 3,967,597 | 7/1976 | Schlagmüller et al. . | |
| 3,980,237 | 9/1976 | Parrish, Jr. . | |
| 4,007,880 | 2/1977 | Hans et al. . | |
| 4,103,827 | 8/1978 | Kumazawa . | |

FOREIGN PATENT DOCUMENTS

| | | | |
|---|---|---|---|
| 498386 | 5/1930 | Fed. Rep. of Germany | 239/533.3 |
| 589552 | 12/1933 | Fed. Rep. of Germany . | |
| 1026572 | 3/1958 | Fed. Rep. of Germany . | |
| 1817471 | 8/1969 | Fed. Rep. of Germany . | |
| 1006552 | 1/1948 | France | 239/533.3 |
| 726248 | 3/1955 | United Kingdom . | |
| 796079 | 6/1958 | United Kingdom | 239/533.3 |
| 906603 | 9/1962 | United Kingdom . | |
| 921949 | 3/1963 | United Kingdom . | |
| 1076184 | 7/1967 | United Kingdom . | |
| 1191119 | 5/1970 | United Kingdom . | |
| 1353621 | 5/1974 | United Kingdom . | |
| 1521641 | 8/1978 | United Kingdom . | |

*Primary Examiner*—Richard A. Schacher

*Attorney, Agent, or Firm*—Russel C. Wells; Markell Seitzman

[57] ABSTRACT

An injector valve having a stable fuel flow while metering "single point" fuel volumes is disclosed. A metering portion of the injector valve comprises a needle valve and a valve housing including a centrally located valve housing bore that terminates in a truncated conical valve seat and cylindrical metering orifice. A transitional surface connects the valve seat to the metering orifice to gradually change the direction of fuel flow so separation and unstable flow will not occur. The needle valve is concentrically reciprocal within the valve housing bore and closes the metering orifice with a valve tip having a closure surface mating with the valve seat. The valve tip narrows from the closure surface into a pintle which extends through the metering orifice and ends in a deflection cap which shapes the spray of the valve into a hollow-cone pattern. The valve tip between the pintle and closure surface has a contoured surface that increases the flow area of the valve tip and valve seat interface to a plateau value downstream of the closure surface and then smoothly decreases the flow area from that value to where fuel exits the metering orifice.

6 Claims, 4 Drawing Figures

INJECTOR VALVE WITH CONTOURED VALVE SEAT AND NEEDLE VALVE INTERFACE

This is a continuation, of application Ser. No. 940,522, filed Sept. 8, 1978 now abandoned.

BACKGROUND OF THE INVENTION

The invention pertains generally to injector valves and is more particularly directed to injector valves having increased fuel flow rates.

Fuel injectors of the electromagnetic solenoid type have been commonly utilized in "multipoint" electronic fuel injection (EFI) systems in the automotive field. Such injectors are located at each cylinder of the engine and spray an atomized charge of fuel into the intake manifold near the associated intake valve. As the intake valve opens, the atomized fuel and air from the intake manifold are drawn into the cylinder and are combusted. By controlling the duration of the operational times of the injectors with a pulse width modulated control signal from an electronic pulse width computer, the precision of fuel delivery has been greatly improved for the internal combustion engine. The fuel is metered accurately with respect to the many and varied operating parameters of the engine including MAP, RPM, temperature and others. With this precision is the ability to improve fuel economy, control emissions, or increase driveability such that the conventional carburetor will probably be displaced in the future by the EFI system as the most prevelant fuel control device.

Another recent development in the fuel control field that may hasten the demise of the conventional carburetor is the "single point" EFI system which, like its counterpart the "multipoint" EFI system, depends upon the precision of electronically controlling an electromagnetic solenoid injector.

"Single point" systems usually have one injector for the delivery of fuel to a plurality of cylinders of an engine at a single injection point instead of the "multipoint" system where a one-to-one correspondence occurs. These injection points may be variably placed inside the intake manifold or the throttle bores of an air flow regulation device leading to the intake manifold. If placed in the throttle bores, these injectors may be located above or below the throttle blades for the most advantageous configuration depending on the particular injector structure. With the substitution of one injector for a plurality of injectors, the "single point" EFI system reduces complexity and expense compared to many "multipoint" schemes while retaining most of the attendant EFI system advantages vis a vis the conventional carburetor.

It is desirable to inject such "single point" systems at least once per engine event (revolution) or even as fast at each intake valve opening. Since one injector replaces a plurality of injectors, sometimes as many as four for an eight-cylinder engine with a two-plane manifold, the "single point" injector generally must have a higher fuel flow rate than a corresponding "multipoint" injector. For use in higher displacement engines a higher flow rate electromagnetic solenoid injector would additionally be highly desirable whether "multipoint" or "single point".

This higher flow rate, because of the preferred single point injection timing, must be accomplished without the sacrifice of injector speed. If possible, it would be desirable for increased control that the injector speed should even be increased. If a higher flow rate is obtained at the expense of operating speed, such as injector will not be as advantageous as if both goals are achieved. The slower the injector opening time, the less overall fuel capacity the injector will be capable of delivering in the high speed range of the engine.

Presently in the art an increased flow rate for an injection valve can be obtained by increasing the metering orifice cross-sectional area, increasing the input pressure, or a combination of both. An increase in the input fuel pressure to a single point system would, however, require the additional expense of a higher pressure fuel pump and pressure regulator combination and is, therefore, unacceptable to the basic premise of single point systems, the reduction of complexity.

However, increasing the metering orifice cross-sectional area by scaling up a conventional "multipoint" injector to a "single point" flow rate creates other problems. Initially, the opening time and thus operation capability of the injector is detrimentally affected because of the increase in the mass of the needle valve. The mass of the needle valve increases in proportion to the volume increase of the material and not linearly with the increase in flow rate. Also, the flow paths of conventional "multipoint" valves are unfavorably restricted for "single point" applications and do not have sufficient flow area therethrough to efficiently handle the increased flow rate to a larger metering orifice.

Such "multipoint" valves are illustrated in U.S. Pat. Nos. 4,007,800 issued to Hans, et al., and 3,967,597 issued to Schlagmuller, et al. Hans, et al. and Schlagmuller, et al. disclose the use of a needle valve in an electromagnetic injector having flats cut on four sides of the shaft. This configuration unduly restricts flow through the injector valve and increases needle mass when utilized in a high flow injector.

A U.S. Pat. No. 3,069,099 issued to Graham illustrates a fuel injection nozzle with a three-sided spring retainer plate. Although this configuration does not restrict fuel flow in the pressure operated injection nozzle shown, it is not advantageously suitable for precision electromagnetic solenoid injection valves where exact metering and sure closure are required.

Another problem encountered in scaling up a conventional "multipoint" injector to a "single point" flow rate is that many injectors will not produce a stable flow at different pressures and times. At one particular pressure, for example, the static flow rate will be different some of the time and the instability unpredictable as to occurence. This defect seems to worsen at higher flow rates and higher pressures, and is unacceptable in the "single point" flow rate and pressure range. Changes of between 5%-7% have been noted in the same injector operated at a particular pressure. The unpredictability of a flow rate from an injector will destroy the precision that the EFI systems have brought to the fuel metering art.

This unstable flow problem seems to be centered in the valve seat metering orifice interface where the cylindrical metering orifice truncates the cone of the valve seat. At higher flow rates it is believed that the fuel accelerates through the closure surface and valve seat interface and then, at unpredictable intervals, will not smoothly flow into the exit orifice. If separation occurs at the exit orifice, the fuel will not be precisely metered by the area between the outer wall of the orifice and a pintle of the valve tip. This effect is similar to the "vena contracta" phenomenon found in hydraulics where a fluid under pressure flows around a sharp corner and has an extreme change of momentum and therefore separates from the surface of an orifice.

With high flow injector valves the angle at which the valve seat intersects the cylindrical metering orifice is relatively large because of the shallow cone angle of the valve seat necessary to produce high flow rates with minimal lift from the needle valve. Reducing this intersection angle without modifying the minimal lift conical valve seat would be highly desirable. A modification to the valve seat and valve tip interface of an injector is illustrated at FIG. 4 of a U.S. Pat. No. 3,241,768 issued to Croft, but is for the purpose of developing a constant flow area.

Another problem that prior art injection valves with high flow rates incur is a residual fuel drop being retained on the injector or injector tip surface which effects the precision of fuel injection on subsequent openings. The residual fuel left on the injector will also cause contamination if it evaporates and can obstruct the metering orifice.

Spray pattern shaping has been attempted with "multipoint" fuel injectors and with "single point" injectors. The shaping of the pattern is important in the "single point" applications, since one injector is entraining the fuel in the air flow at a particular time and the consequent change is to be delivered to particular multiples of the cylinders. If the air fuel ratio precision is to be maintained and cylinder-to-cylinder distribution errors minimized, the flow pattern must be correctly designed and reproducible with every injection. This will minimize wall wetting and unwanted condensation of the fuel on the throttle and other surfaces.

One of the spray patterns becoming popular in "single point" injection is the hollow-cone pattern where the fuel is limited to a volume between two differently-sized cones having their apex at the injector tip. It would be advantageous to be able to reproduce such a pattern with the same injector structure over a wide range of operating pressures and flow rates.

SUMMARY OF THE INVENTION

The invention provides an improved high flow rate injector valve having a stable flow, minimal residual contamination, and a hollow-cone spray pattern.

The injector valve comprises a metering portion including a valve housing and a needle valve and means for moving the needle valve reciprocally in the valve housing. Preferably, the means for moving the needle valve is an electromagnetic solenoid, but other sources are equally applicable to the invention.

The valve housing has a centrally located valve housing bore that terminates in a truncated conical valve seat and cylindrical metering orifice. According to one aspect of the invention, a transitional surface connects the valve seat to the metering orifice. Preferably, the transitional surface is, in cross-section, a curve that smoothly changes the flow direction of the fuel to prevent flow separation from the cylindrical metering orifice. The transitional surface promotes stable flow and solves the problem of unpredictable flow rates from the injection valve.

The needle valve is concentrically reciprocal within the valve housing and closes the metering orifice with a valve tip having a closure surface mating with the valve seat. The valve tip narrows from the closure surface into a pintle which extends through the metering orifice and ends in a deflection cap.

According to another aspect of the invention, the valve tip between the closure surface and pintle is contoured to increase the flow area of the valve tip and valve seat interface to a plateau level and then smoothly decreases the flow area to where the fuel exits the metering orifice. The valve tip contour allows the recovery of pressure from the closure surface restriction to promote stable fuel flow and assists the transitional surface to provide reproducible injections.

According to still another aspect of the invention, the deflection cap on the pintle shaft forms a pinula which has a flat deflection surface ending in an edge substantially perpendicular to the spray axis of the injector valve. By controlling the diameter of the circular base of the deflection cap and its distance from the annular flow channel formed between the metering orifice and pintle, the included angles of a hollow-cone spray pattern can be regulated without affecting the metered flow from the valve. The hollow-cone pattern can be effected with this configuration over a wide range of pressures and flow rates.

The straight pintle stem, sharp edge of the deflection surface, and the capillary action of the annular flow channel further combine to form a configuration which is less susceptible to the formation of residual fluid on the end of the injector valve when closed. The configuration minimizes the surface area available for formation and tends to hold any residual fluid adjacent to the annular flow channel by capillary action.

Therefore, it is an object of the invention to prevent unstable flow from occurring in injector valves having "single point" flow rates.

It is another object of the invention to produce a stable flow rate from an injector valve by contouring the interface between valve seat and metering orifice.

It is still another object of the invention to produce a stable flow rate from an injector valve by contouring the valve tip between the closure surface and the pintle to increase the flow area at that point.

Yet another object of the invention is to prevent residual drop formation on the end of the injector while providing a controllable hollow-cone spray pattern generator.

These and other objects, features, and aspects of the invention will be clearer and more fully understood from a reading of the detailed description when taken in conjunction with the appended drawings wherein:

DETAILED DESCRIPTION OF THE PREFERRED EMBODIMENT

Figure 1:
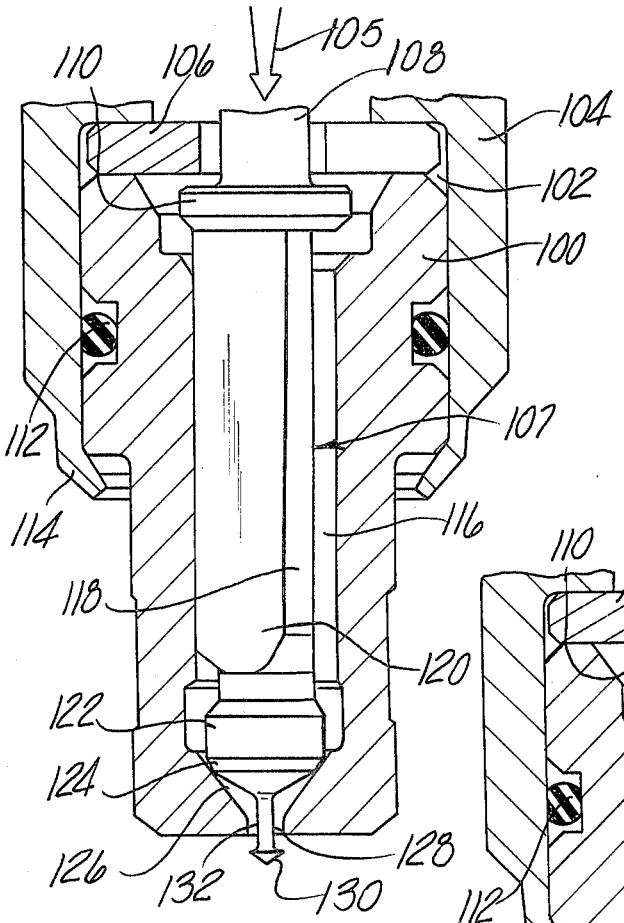
FIG. 1 is a cross-sectional side view of an injector housing and needle valve metering combination shown in a closed position that has been constructed in accordance with the invention.

An injector valve metering portion having a "single point" fuel flow rate is illustrated in FIG. 1 in a closed position and comprises a valve housing 100 and needle valve 107 mounted in an injector housing 104 of the valve. The construction of the injector valve other than the metering portion is not shown as it is conventional and not pertinent to a discussion of the invention. Such portions could, for example, comprise a solenoid connected at the armature to the needle valve 107 as illustrated in the referenced Hans, et al., the disclosure of which is incorporated by reference.

The valve housing 100 is received into a mounting chamber 102 of an injector housing 104 and is spaced exactly by a C-shaped spacer washer 106 which has its dimensions accurately controlled by machining both facial surfaces. The valve housing 100 is held securely in the mounting chamber 102 by crimping the rim 114 of the injector housing 104 over an outside shoulder of the valve housing. A suitable O-ring 112 is used to seal the interface of the mounting chamber 102 and the valve housing 100.

The valve housing 100 is provided with an essentially central valve housing bore 116. The needle valve 107 comprises a shank portion 108 which fits through C-shaped spacer 106 and then flares into a radially outgoing spacer collar 110. The spacer collar 110 adjoins a generally triangular cross-section medial section having three equilateral bearing surfaces 118 spaced equally about the valve housing bore 116 to center the needle valve 107 within the bore.

The medial section connects to a valve tip 122 having a closure surface 124 which mates with a truncated conical valve seat 126 and then narrows to finally become an elongated pintle 128. The pintle 128 extends through a cylindrical metering orifice 132 and terminates in a deflection cap 130. The bearing surfaces 118 slide within the bore 116 and are connected by relieved surfaces 120 forming fuel flow passages between them and the valve housing bore 116.

Fuel under pressure flows into the fuel passages between the needle valve and valve housing bore 116 from a pressurized source (not shown) which feeds fuel through the opening in the spacer washer 106. The fuel is prevented from exiting an annular fuel passage formed between the cylindrical orifice 132 and the pintle 128 by means of a closure force 105 forcing the needle valve tip into sealing relationship with the valve seat 126.

Figure 2:
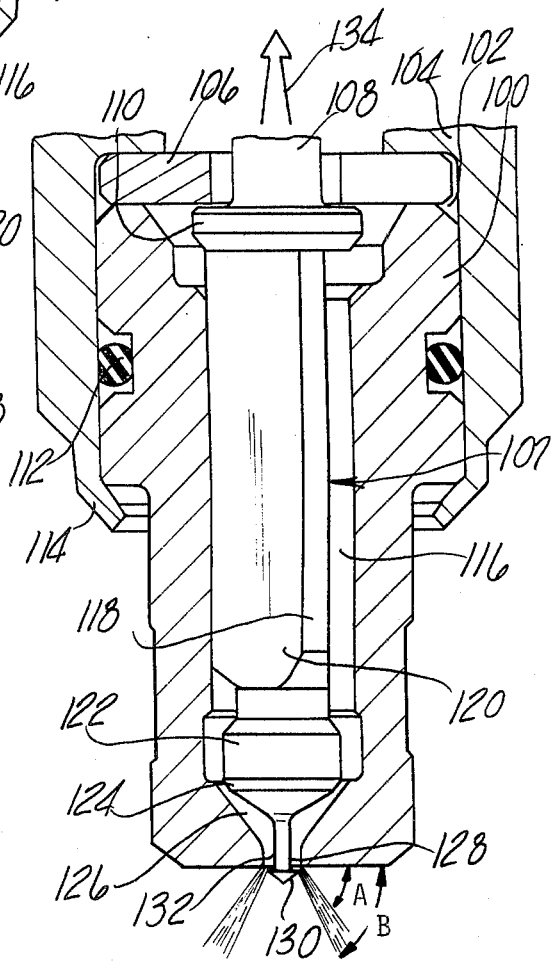
FIG. 2 is a cross-sectional side view of the injector housing and needle valve combination illustrated in FIG. 1 which is shown in an open position.

In FIG. 2, fuel is metered from the valve by applying an opening force 134 lifting the needle valve 107 away from the seat and allowing fuel to pass through the closure surface 124 and valve seat interface 126 and, thereafter, the orifice 132. The needle valve 107 is lifted to where the spacer collar 110 abuts washer 106. The opening force 134 and closure force 105 can be provided by a number of means such as a solenoid, pressure, or mechanical. Preferably, said force is provided by an electromagnetic solenoid with its armature attached to the shank portion 108 of the needle valve 108, such as shown in co-pending application Ser. No. 940,524 entitled "Injection Valve With Increased Fuel Flow Rate and Decreased Valve Mass", filed in the name of W. B. Claxton and commonly assigned with the present application. The disclosure of Claxton is hereby expressly incorporated by reference herein.

When the valve is open, fuel is metered through the annular passage formed by the pintle 128 and cylindrical metering orifice 132. The flow area of the passage is precisely controlled to permit a desired amount per unit time at the operating pressure of the valve to be injected. The fuel flow is shaped into a hollow-cone pattern by the deflection cap 130. The pattern has an outer cone angle A and an inner cone angle B between which substantially all of the fuel flow is contained.

Figure 3:
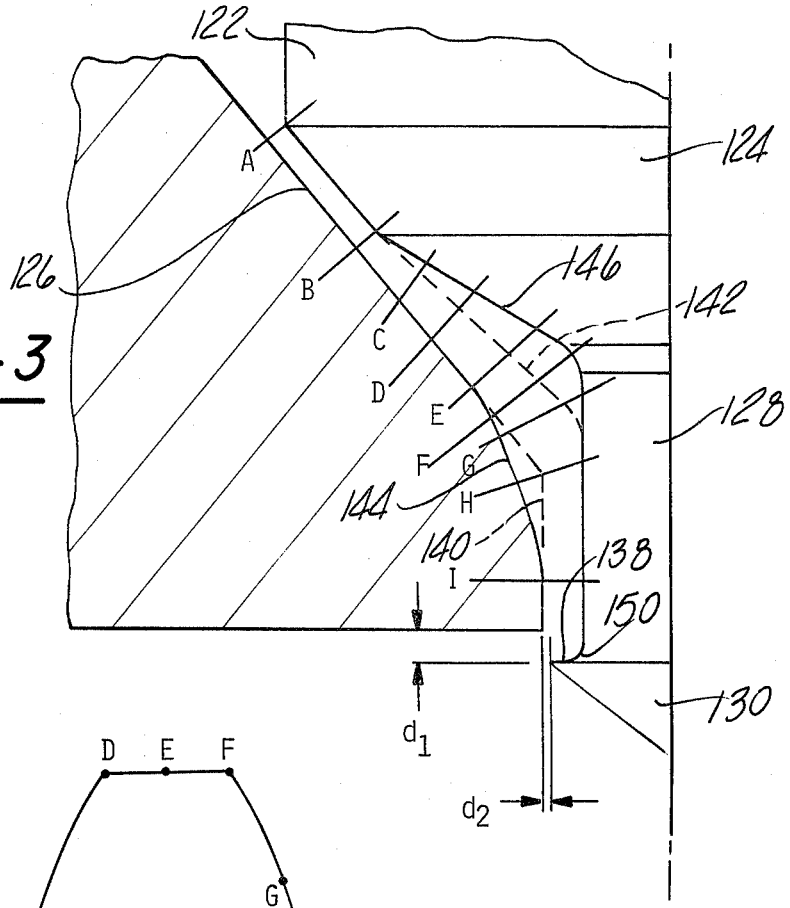
FIG. 3 is an enlarged fragmentary side view in cross-section of the contoured valve seat and needle valve interface for the metering combination illustrated in FIGS. 1 and 2.

FIG. 3 shows an enlarged cross-sectional view of the interface between the valve tip 122 and the valve seat 126. It is seen from the figure that the valve seat and metering orifice intersection, which was previously a sharp corner with a relatively large angle as indicated by dotted line 140, has been contoured into a transitional surface 144 which smoothly changes the direction from the conical face of the valve seat to the cylindrical orifice. The transitional surface 144 is shown as a curve beginning at the exit orifice and sweeping to where it becomes tangent to the valve seat surface 126.

This shape is the preferred form and can be in cross-section a circular arc or higher ordered curve, but any transitional surface which changes fuel direction gradually enough to not cause separation or cavitation in the fuel flow would be acceptable for the interface. The simplest form of the transitional surface could be a truncated conical surface beginning at the valve seat and connecting the cylindrical metering orifice. The transitional conical surface could have a greater slope than the valve seat, but less than the vertical angle of the metering orifice.

Figure 4:
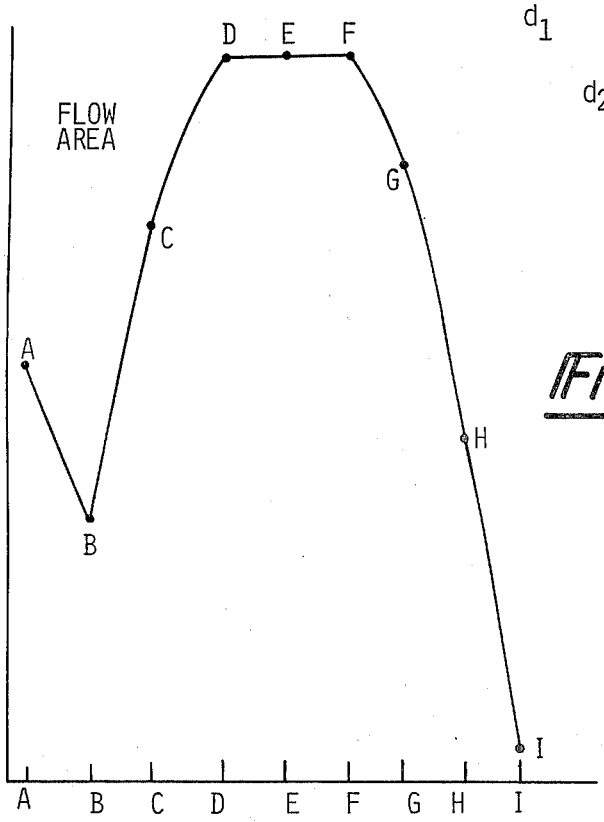
FIG. 4 is a graphical representation of the flow area as a function of various positional points along the valve seat and needle valve interface illustrated in FIG. 3.

To compliment the transitional area, the valve tip 122 between the closure surface and the pintle has also been contoured from its previous shape, as shown by the dotted line at 142, to the present surface illustrated at 146. Taking cross-sectional flow area at different positions between the valve tip and the valve seat interface, it is seen in FIG. 4 that the flow area decreases from point A to point B because of the closure surface and valve seat restriction. From point B to point D it gradually increases to where a plateau level is reached at points D-F. From point F to the flow area of the annular passage, I, the flow area gradually and smoothly decreases.

The flow area between points B and points F allows the fuel to recover pressure lost going through the restricted area from A to B and slows the velocity. From point F the smooth entry of the fuel along the transitional surface into the exit of the metering orifice 132 keeps the fluid from dropping below the vapor pressure so the flow rate is stable and cavitation and separation are prevented.

The contour of the valve tip 122 and the contour of the transitional surface 144 both contribute to providing a metering valve which is stable in flow rate. Each can, however, be used individually to effect stability in injection valves, but the features preferably are used in combination to create a uniting of their individual contributions.

The shaping of the hollow cone spray pattern is accomplished by the deflection cap 130 which is formed on the end of the pintle as a cone with a flat deflection edge 138 and small fillet 150 connecting to the shaft of the pintle 128. A spray axis C-C indicates the direction of fluid momentun as the fuel exits the orifice 132. Assuming a constant pressure for the injector, the hollow-cone spray pattern is generated by controlling three variables which are: the annular flow area of the fuel passage between the metering orifice and pintle, the distance between the injector housing end and the flat deflection surface 148 designated $d_1$, and the difference in the orifice diameter and the diameter of the base of the deflection cap designated $d_2$.

Generally, the smaller the distance $d_1$, the wider the spray pattern will be when the injector is open. Similarly, the smaller the distance $d_2$ is, the wider the spray pattern angle. One limitation is that the distance $d_1$ must be greater than that necessary to prevent restriction of the metering orifice as the deflection cap 130 is for the purpose of separating the shaping function from the metering function in the present valve.

The fuel flow, as it comes out and impinges upon the deflection surface 138, changes the direction of the fluid flowing the deflection distance $d_2$ to form the two hollow-cone spray angles A & B. The fluid deflected substantially perpendicular to the spray axis C-C by the deflection surface 138 will cause movement away from spray axis in the horizontal direction by a component related to the amount of flow and the amount of flow deflected. The larger the amount of flow deflected to that of the entire flow, the smaller the angles A and B of the hollow-cone pattern.

As an example, a hollow-cone spray pattern with an inner cone angle B of 60° and an outer cone angle A of 30° can be formed by an injector having a metering orifice of 0.033" diameter and a pintle diameter of 0.022". The distance $d_1$ for this injector would be approximately 0.016" and the distance $d_2$ would be 0.0005", or having a deflection cap with an outside base diameter of 0.032". Such an injector would be designed to run at approximately 40 PSI and have a single float point flow rate of between 40 or 50 lbs./hr.

A lower pressure injector running at approximately 15 PSI and the same flow rate with an inner cone angle B of 30° and an outer cone angle A of 10° can be advantageously manufactured by having a metering orifice of 0.044" with a pintle outside diameter of 0.025". This valve would have distance $d_1$ of 0.024". For this spray angle, a difference of 0.001", or distance $d_2$, between the outside diameter of the base of the deflection cap and the metering orifice is desired, or where the base of the deflection cap equals 0.042" in diameter.

While the preferred embodiments of the invention have been shown, it will be obvious to those skilled in the art that modifications and changes may be made to the disclosed system without departing from the spirit and scope of the invention as defined by the appended claims.

What is claimed is:

1. A fuel injection valve having a high flow rate metering portion comprising:

a valve housing having a fuel flow passage which communicates fuel from a pressurized source to a truncated conical valve seat having a closure surface, said seat converging toward the axis thereof and intersecting a cylindrical metering orifice axially aligned with said flow passage;

a needle valve, reciprocal in said fuel flow passage, including a valve tip having a closure surface which is operable to close the injection valve when brought into contact with said closure surface of said valve seat, the surface of said valve tip converging toward the axis thereof for forming a pintle and an annular fuel passage with said valve seat in the area downstream of said closure surface and upstream of said metering orifice for decreasing the pressure drop of the fuel therethrough; and an abruptless transitional curving surface on said valve seat beginning at said cylindrical metering orifice and tangentially ending at said closure surface, said transitional surface cooperating with said pintle for maintaining the fluid flow through said annular fuel passage so as not to induce flow separation and cavitation from said cylindrical metering orifice.

2. A fuel injection valve with a metering portion as defined in claim 1 wherein:

said transitional surface is formed as a truncated conical surface with a greater conical slope than said valve seat.

3. A fuel injection valve as defined in claim 1 wherein:

said valve tip narrows into a pintle which extends through said metering orifice, said valve tip being contoured between said closure surface and said pintle such that the cross sectional flow area of said annular fuel passage increases to a plateau value and subsequently decreases smoothly to where the fuel exits said metering orifice.

4. A fuel injection valve as defined in claim 3 wherein said valve tip pintle terminates in a deflection cap having a deflection surface substantially perpendicular to the injector spray axis and the perimeter of said deflection surface being similar to the perimeter of said cylindrical metering orifice.

5. An injection valve as defined in claim 4 wherein:

said deflection surface controllably forms a hollow-cone spray pattern with an inner cone angle and outer cone angle by varying both the longitudinal distance between said deflection surface and the exit of said metering orifice and the space between said perimeter of said deflection surface and the perimeter of said cylindrical metering orifice such that the perimeter of said deflection surface is less than the perimeter of said metering orifice.

6. An injection valve as defined in claim 5 wherein:

said inner and outer cone angles are formed by varying the flow area of said annular fuel passage formed between said pintle and said cylindrical metering orifice.

* * * * *